United States Patent [19]

Paulus

[11] 4,297,398

[45] Oct. 27, 1981

[54] MANUFACTURING COATED STEEL STRIP

[75] Inventor: Philippe Paulus, Liege, Belgium

[73] Assignee: Centre de Recherches Metallurgiques-Centrum voor Research in de Metallurgie

[21] Appl. No.: 126,387

[22] Filed: Mar. 3, 1980

[30] Foreign Application Priority Data

Nov. 2, 1979 [BE] Belgium ..... 874599

[51] Int. Cl.[3] ..... C23C 1/02; C23C 1/08

[52] U.S. Cl. ..... 427/320; 427/321; 427/319; 427/398.3; 148/143

[58] Field of Search ..... 427/398.3, 374.5, 320, 427/319, 321; 148/143, 28

[56] References Cited

U.S. PATENT DOCUMENTS

| | | | |
|---|---|---|---|
| 1,635,025 | 7/1927 | Ball | 148/28 |
| 2,062,795 | 12/1936 | Pike | 427/398.3 |
| 2,166,510 | 7/1939 | Whitfield et al. | 427/374.5 |
| 2,588,439 | 3/1952 | Ward | 427/374.5 |
| 2,950,991 | 8/1960 | Seymour | 427/374.5 |
| 3,322,560 | 5/1967 | Monaco | 427/398.3 |
| 3,782,909 | 1/1974 | Cleary et al. | 427/398.3 |
| 3,902,929 | 9/1975 | Meszaros | 148/28 |

*Primary Examiner*—Ralph S. Kendall

*Attorney, Agent, or Firm*—Holman & Stern

[57] ABSTRACT

Steel strip is dipped in a molten metal bath (e.g. Al-Zn) maintained at above 500° C., cooled to solidify the metal coating, and then cooled to below 475° C. by an intense and rapid cooling operation which does not impair the flatness of the strip, e.g. immersion in a hot aqueous bath or spraying a mist. Before hot-dipping, the steel strip is preferably recrystallisation annealed and cooled to a temperature not lower than that of the molten metal bath.

9 Claims, 2 Drawing Figures

$(\Delta t = t_1 + t_2)$

MANUFACTURING COATED STEEL STRIP

Figure 1:
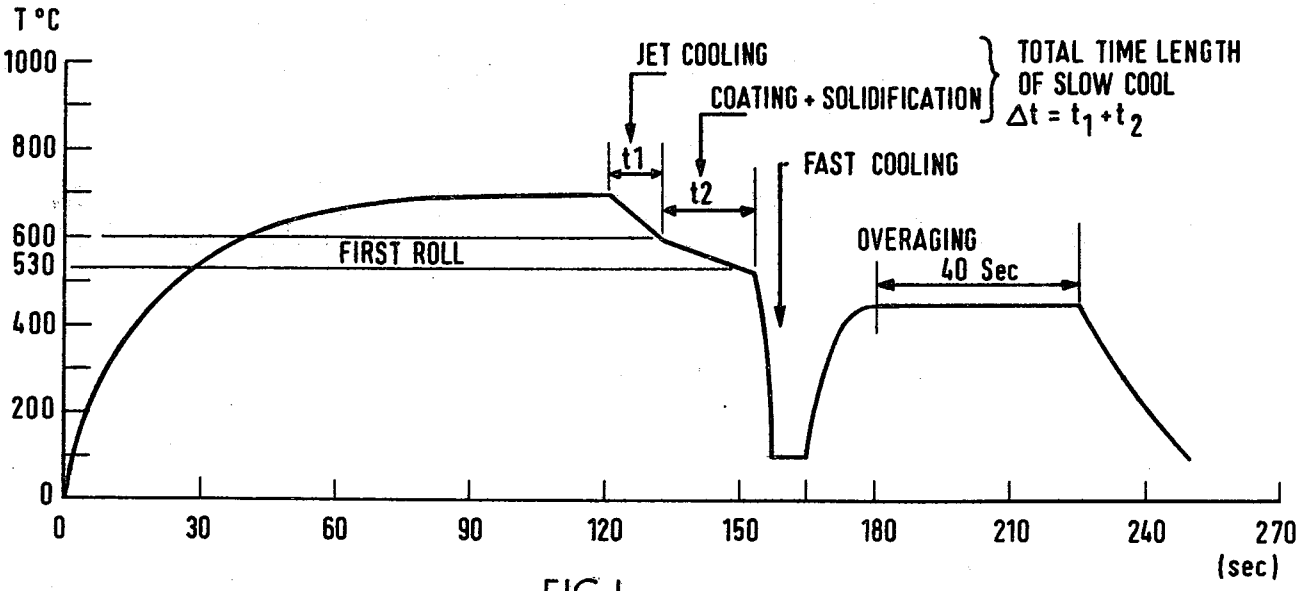

The present invention relates to a method of manufacturing coated steel strip having good drawing and/or ductile properties. This invention is particularly advantageous in the case in which the strip is coated by immersion in a bath whose basic constituent is a mixture of zinc and aluminium.

The main properties which users require from coated steel strip are, inter alia, drawing properties which are as high as possible for the steel grade used, and, according to the conditions and the use for which the strip is intended, satisfactory fatigue strength, ductility, and weldability.

We have observed that the type of cooling applied to steel strip on its discharge from a dip-coating bath was of considerable importance in this respect and we have developed a method based on these observations:

The present invention provides a method in which steel strip is immersed in a metallic bath at a temperature higher than 500° C., the strip is subjected to a first cooling on discharge from the bath, until the temperature at which the metallic layer covering the strip has solidified has been reached, and then to an intense cooling, which does not however impair the flatness of the strip, to a temperature lower than 475° C.

It is advantageous if the strip has been heated, before immersion, to a temperature higher than its recrystallisation temperature, held at this temperature, preferably for more than 30 seconds, then cooled to a temperature which is not lower than that of the bath.

Preferably, the period of time between the time when the strip having a temperature higher than its recrystallisation temperature begins to be cooled and the time when, after discharge from the bath, the metallic coating layer has solidified, is not shorter than 20 seconds and is not longer than 100 seconds, which enables a coated strip having particularly advantageous features to be obtained.

According to one embodiment of the invention, in the case of mild steel strip (for drawing), the intense and rapid cooling is continued until a temperature of between 375° and 475° C. is reached and is followed by holding the strip at the final cooling temperature for a duration greater than 30 seconds, and then by a second, slower cooling to ambient temperature by any suitable means known per se.

In the case in which dead soft steel strip is to be processed, the final temperature of the intense cooling is lower than 350° C., the strip is then subjected to a reheating operation in a suitable furnace until a temperature in the range of 400° to 500° C. has been reached, and, after holding for at least 30 seconds at this temperature, it is then subjected to slow cooling until ambient temperature is reached.

In accordance with a further embodiment of the invention, in the case of fine high-strength steel sheet, the intense and rapid cooling is carried out to a temperature below 300° C., and preferably to 250° C., and is immediately followed by a second slower cooling to ambient temperature by any suitable means known per se.

The bath in which the strip to be coated is immersed is preferably composed of one or a plurality of elementary metals or alloy metals, whose melting point is lower than 800° C., preferably 700° C. Amongst these metals, attention is drawn to light metals such as aluminium and their alloys. A particularly advantageous bath consists of aluminium and zinc.

The intense and rapid cooling of the strip on its discharge from the coating bath may be carried out by quenching in an aqueous bath maintained at a temperature higher than 75° C., and preferably at its boiling point. We have already demonstrated, in other fields, such as for example the continuous annealing of galvanised or non-galvanised sheet, the advantages provided by quenching in an aqueous medium of this type, i.e. that it provides this sheet with an excellent elastic limit—elongation combination, and consequently makes it very suitable for drawing and provides it with very homogeneous properties over its entire width. The aqueous bath in which the sheet is immersed for rapid cooling may be composed solely of water or may contain suspensions and/or solutions of substances capable of modifying the heat exchange coefficient, for example salts (in particular calcium chloride or borax) or surfactants such as palmitates, stearates, sodium or potassium oleate, and possibly corrosion inhibiting substances.

Alternatively, the intense and rapid cooling of the strip on its discharge from the cooling bath may be carried out by a fluid spray constituted by a homogeneous mist of water suspended in a gas, preferably air. We have developed a sprayer capable of performing cooling of this type, which is disclosed in Belgian Pat. No. 853,821. This sprayer comprises a central conduit having the form of a Laval tube and at least one lateral conduit communicating with the outlet end of the divergent portion of the central conduit at an inclination greater than 30°, and preferably approximately 45°. The central conduit is supplied with atomising gas (preferably air, but possibly nitrogen) at the input end of the convergent portion and the lateral conduit is supplied with water to be atomised. A bank of these sprayers has a specific cooling power which may reach more than 3 megawatts per $m^2$ and which may be varied over a wide range (in the range of 1 to 10), without losing its uniform cooling ability. These sprayers have the additional advantage of high efficiency, and thus reduced water consumption for the same cooling power.

Figure 2:
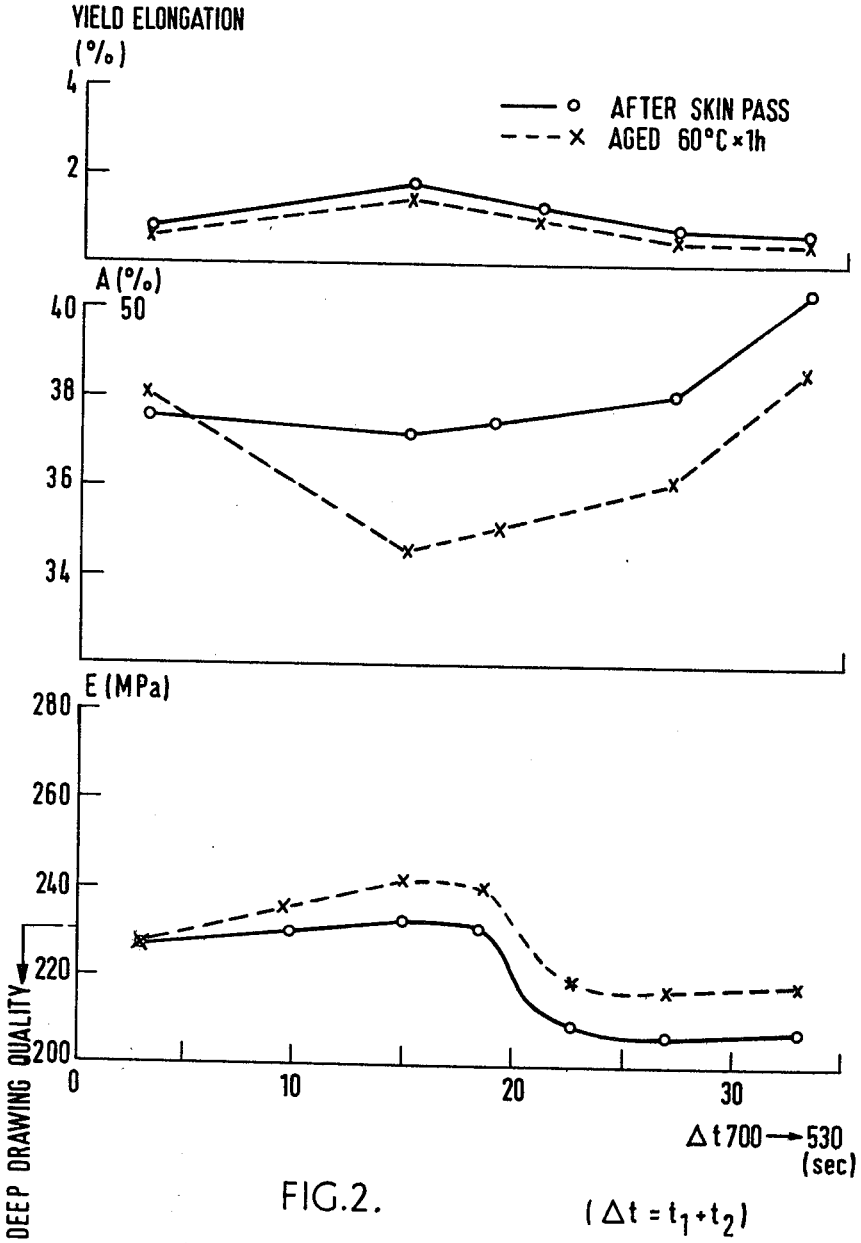

In the accompanying drawings:

FIG. 2 is a graph of temperature (T° C.) against time (seconds) for the heat treatment and hot-dip coating of dead soft steel sheet; and FIG. 2 is a graph of yield elongation (%), after skin-pass rolling and after ageing for 1 hour at 60° C., of elongation at fracture ($A_{50}$,%), and of elastic elimit (E,MPa), all plotted against a period of time $t=t_1+t_2$, where $t_1$=duration cooling from annealing temperature (700° C.) to dipping temperature (approx. 610° C.) and $t_2$=duration of dipping and solidification of the coating (to 530° C.).

EXAMPLES

1. Ordinary grade dead soft steel strip

The cold-rolled strip, having a thickness of 0.8 mm, was treated in a continuous coating line by immersion in a molten bath composed mainly of aluminium and zinc.

Preliminary treatment consisted in heating the strip in a non-oxidising naked flame furnace to a temperature of 700° C. and then holding it at this temperature for a short period, approximately 35 seconds. The strip was then cooled for 10 seconds to 600° C. and immediately after this plunged into the Al-Zn bath, which was at a temperature of 590° C.

On discharge from the bath, the strip was rapidly cooled for 5 seconds to a temperature of 510° C. to solidify the coating, then very rapidly to 425° C., and the strip was then held at this temperature for 45 seconds. The very rapid cooling was carried out by immersing the strip in an aqueous bath containing a passivating element, such as potassium bichromate or chromic acid, the bath being held at 95° C.

The treatment was completed by slow cooling for 45 seconds to a temperature of 80° C.

For purposes of comparison, the same steel strip was treated in accordance with a known coating method comprising hot dipping with a single cooling step in discharge from the bath, consisting in lowering the temperature of the strip from 590° C. (temperature of the coating bath) to 80° C. in one minute.

The following results were obtained:

| | Method of the invention | Known Treatment |
|---|---|---|
| Elastic Limit | 250 MPa | 330 MPa |
| Tensile Strength | 350 MPa | 370 MPa |
| Elongation | 38% | 35% |

The clear increase in elongation should be noted, this being very suitable for drawing treatments.

2. High strength coated steel sheet

Steel sheet, having the following composition by weight: C: 0.06%, Mn: 0.8%, Si: 0.1%, Al: 0.05%, the balance being iron containing the normal impurities, was treated in a continuous coating line by immersion in a molten bath substantially composed of aluminium and zinc.

Preliminary treatment consisted in heating the sheet in a non-oxidising naked flame furnace to a temperature of 800° C., then in holding it at this temperature for a short period, approximately 30 seconds. The sheet was then cooled for a period of 20 seconds to 650° C. and immediately after this was plunged into the Al-Zn bath, which was at a temperature of 620° C.

On discharge from the bath the sheet was cooled rapidly for 10 seconds, to 530° C., in order to solidify the coating, then very rapidly for 2.5 seconds to 20° C. by means of a bank of sprayers spraying a mist of water suspended in air, the sprayers being as described in Belgian Pat. No. 853,821.

For purposes of comparison, the same steel sheet was treated in accordance with a known coating method consisting in hot dipping, with cooling to 20° C. in 1 minute on discharge from the bath.

The following results were obtained:

| | Method of the Invention | Known Treatment |
|---|---|---|
| Elastic Limit | 380 MPa | 350 MPa |
| Tensile Strength | 480 MPa | 420 MPa |
| Elongation | 33% | 32% |

It is noted that the tensile strength of the sheet treated in accordance with the invention is clearly higher than that of the same sheet treated in accordance with the known method.

3. Dead soft steel sheet for deep drawing

Type of coating bath: zinc—aluminium alloy.

Bath temperature: 600° C.

Temperature at beginning of rapid cooling (after solidification of coating): 530° C.

Rapid cooling method: immersion in an aqueous bath at its boiling point. The steel treated was dead soft steel having the following composition, in percent by weight:

| C | Mn | Si | Al | S | P | $N_2$ |
|---|---|---|---|---|---|---|
| 0.067 | 0.290 | — | — | 0.015 | 0.010 | 0.0045 |

It was hot-rolled with a final rolling temperature of 880° C. and a winding temperature of 700° C. to a thickness of 2.5 mm, then cold-rolled to a thickness of 0.8 mm.

In the coating line, it was subjected to the following heat treatment, as exemplified in FIG. 1:

rapid heating to 700° C.;

holding at this temperature for more than 30 s (annealing);

cooling by blasting of atmospheric gas for varying lengths of time to a temperature of approximately 610° C., before dipping;

on discharge from the coating bath, "drying" of the coating and cooling to 530° C. for variable lengths of time;

immersion in an aqueous bath at its boiling point, the sheet being discharged at temperatures between 150° and 350° C.;

rapid reheating to 450° C. and holding at this temperature for varying lengths of time;

final air cooling to 80° C. for 45 seconds.

By way of comparison, the same steel was treated in accordance with a known heat treatment cycle, consisting of continuous cooling for 1 minute to 80° C. on discharge from the molten coating bath.

Results (1) Known treatment:

| | after skin-pass | after ageing at 60° C. for 1 hour |
|---|---|---|
| Elastic Limit E (MPa) | 250 | 270 |
| Tensile strength R (MPa) | 350 | 355 |
| Elongation (base 50 mm), $A_{50}$ (%) | 38% | 36% |

(2) Treatment according to the invention:

(a) Effect of the total length of slow cooling between annealing and the beginning of rapid cooling after coating.

This effect is shown in FIG. 2, which was obtained by varying solely this parameter, the others being fixed as follows:

sheet temperature or discharge from the aqueous bath used for the rapid cooling: 150° C.

duration of holding at 450° C.: 45 seconds.

It can be seen that there was clear annealing of the steel for total slow cooling durations higher than 20 seconds.

(b) Effect of the temperature of discharge from rapid cooling (before re-heating to 450° C.).

The following results were obtained with the other parameters fixed as follows:

total duration of slow cooling: 27 seconds duration of holding at 450° C.: 45 seconds

| Temperature on discharge from rapid cooling (°C.) | Elastic Limit, E (MPa) | | Tensile strength, R (MPa) | | Elongation $A_{50}$ (%) | |
|---|---|---|---|---|---|---|
| | S* | V* | S* | V* | S* | V* |
| 450 | 240 | 260 | 340 | 350 | 39 | 36.0 |
| 400 | 235 | 253 | 338 | 346 | 38.7 | 36.0 |
| 350 | 230 | 246 | 335 | 342 | 39.7 | 36.3 |
| 300 | 214 | 230 | 326 | 332 | 41.0 | 38.0 |
| 250 | 208 | 225 | 320 | 326 | 42.6 | 40.6 |
| 200 | 204 | 215 | 318 | 322 | 43.1 | 41.2 |
| 150 | 205 | 212 | 321 | 324 | 42.5 | 41.0 |
| 100 | 206 | 215 | 319 | 323 | 43.0 | 41.4 |

*S = after skin-pass
*V = after ageing at 60° C. for 1 hour

It may be seen that the quality required for deep drawing was obtained when the temperature on discharge from rapid cooling was lower than or equal to 350° C. In the same way, the ageing tendency is strongly reduced below this temperature.

(c) Effect of the duration of holding at 450° C. or overageing duration.

This parameter was studied with the others fixed as follows:

total duration of slow cooling: 30 seconds temperature at the end of rapid cooling: 150° C.

| Overageing duration at 450° C. (sec.) | Elastic limit, E (MPa) | | Tensile strength (MPa) | | Elongation $A_{50}$ (%) | |
|---|---|---|---|---|---|---|
| | S* | V* | S* | V* | S* | V* |
| 15 | 230 | 243 | 336 | 340 | 39.1 | 35.8 |
| 30 | 208 | 215 | 324 | 332 | 41.0 | 40.4 |
| 45 | 205 | 212 | 321 | 324 | 42.5 | 41.0 |
| 60 | 204 | 210 | 322 | 324 | 42.4 | 41.2 |
| 90 | 206 | 212 | 324 | 328 | 42.0 | 40.6 |
| 120 | 208 | 212 | 323 | 326 | 41.8 | 40.0 |

*S = after skin-pass
*V = after ageing at 60° C. for 1 hour

It is observed that improved properties of ductility and resistance to ageing are obtained for overageing durations of at least 30 seconds.

In the present specification, the expression "ordinary grade mild steel" should be taken as the steel corresponding to the German standard DIN. U. St. 12, and the expression "dead soft steel" (for drawing) should be taken as the steel corresponding to the German standard DIN. U. St. 13.

I claim:

1. A method of manufacturing coated steel strips comprising the sequential steps of:

heating the strip to a temperature higher than its recrystallization temperature, holding the strip at this temperature, cooling the strip to a temperature now lower than that of a subsequent bath in a preliminary cooling stage, immersing the strip in a molten metal bath maintained at a temperature higher than 500° C., the molten metal having a melting point lower than 800° C., cooling the strip until the metal coating has solidified in a first cooling stage, and subjecting the strip immediately thereafter to a more intense and more rapid second cooling stage which does not impair the flatness of the strips to a temperature lower than 475° C. by quenching the strip in an aqueous bath held at a temperature higher than 75° C., followed by more slowly cooling the strip to ambient temperature;

with the proviso that the period of time between the beginning of the preliminary cooling stage and the beginning of the second cooling stage is not shorter than 20 seconds and not longer than 100 seconds.

2. A method of manufacturing coated steel strips comprising the sequential steps of:

heating the strip to a temperature higher than its recrystallization temperature, holding the strip at this temperature, cooling the strip to a temperature not lower than that of a subsequent bath in a preliminary cooling stage, immersing the strip in a molten metal bath maintained at a temperature higher than 500° C., the molten metal having a melting point lower than 800° C., cooling the strip until the metal coating has solidified in a first cooling stage, and subjecting the strip immediately therafter to a more intense and more rapid second cooling stage which does not impair the flatness of the strips to a temperature lower than 475° C. by spraying the strip with a homogeneous mist of water suspended in gas, followed by more slowly cooling the strip to ambient temperature;

with the proviso that the period of time between the beginning of the preliminary cooling stage and the beginning of the second cooling stage is not shorter than 20 seconds and not longer than 100 seconds.

3. A method as claimed in claim 1 or 2, in which the strip is mild steel strip, the second cooling stage being carried out to a temperature between 375° C. and 475° C., followed by holding the strip at the temperature of the end of cooling for at least 30 seconds, and then more slowly cooling the strip to ambient temperature.

4. A method as claimed in claim 1 or 2, in which the strip is dead soft steel strip, the second cooling stage being carried out to a temperature lower than 350° C., followed by reheating the strip to a temperature in the range of 400° C. to 500° C. holding the strip at this temperature for at least 30 seconds, and then slowly cooling it to ambient temperature.

5. A method as claimed in claim 1 or 2, in which the strip is fine high-strength steel strip, the second cooling stage being carried out to a temperature lower than 300° C. followed immediately by slower cooling to ambient temperature.

6. The method of claim 1 or 2, wherein the molten metal has a melting point lower than 700° C.

7. A method as claimed in claim 6, in which the molten metal is composed of aluminium and zinc.

8. The method of claim 1, or 2, wherein the strip is held at the temperature higher than its recrystallization temperature for more than 30 seconds.

9. The method of claim 1 or 2, wherein the aqueous bath contains suspensions, solutions, or mixtures thereof, of at least one substance capable of modifying the heat exchange coefficient, selected from the group consisting of: calcium chloride, borax, palmitate surfactants, stearate surfactants, sodium oleate, potassium oleate, and corrosion inhibitors.

* * * * *